United States Patent [19]

Greiner et al.

[11] Patent Number: 4,712,041

[45] Date of Patent: Dec. 8, 1987

[54] COLOR CRT TENSION MASK SUPPORT ASSEMBLY WITH A GLASS FRAME

[75] Inventors: Siegfried M. Greiner, Crystal Lake; Kazimir Palac, Carpentersville, both of Ill.

[73] Assignee: Zenith Electronics Corporation, Glenview, Ill.

[21] Appl. No.: 754,787

[22] Filed: Aug. 20, 1985

[51] Int. Cl.[4] ..... H01J 29/07; H01J 29/88

[52] U.S. Cl. ..... 313/407; 313/408; 313/477 R; 313/479

[58] Field of Search ..... 313/407, 408, 477 R, 313/477 HC, 479, 404, 402

[56] References Cited

U.S. PATENT DOCUMENTS

| | | | |
|---|---|---|---|
| 2,755,405 | 7/1956 | Wilhelm | 313/404 |
| 3,404,303 | 10/1968 | Levin . | |
| 3,450,920 | 7/1969 | Engels et al. | 313/402 |
| 3,489,966 | 1/1970 | Bradu et al. . | |
| 3,502,942 | 3/1970 | Khan et al. . | |
| 3,541,373 | 11/1970 | Barr . | |
| 3,802,757 | 4/1974 | Benda et al. | 313/479 X |
| 3,898,510 | 8/1975 | Davis et al. | 313/479 X |
| 4,230,965 | 10/1980 | Brenner, Jr. | 313/407 |
| 4,243,908 | 1/1981 | Brenner, Jr. | 313/407 |
| 4,333,033 | 6/1982 | Cordingley et al. | 313/407 |
| 4,333,037 | 6/1982 | Andre et al. | 313/408 X |
| 4,344,015 | 8/1982 | Marschka | 313/479 X |
| 4,433,267 | 2/1984 | Kuryla et al. | 313/407 X |
| 4,547,696 | 10/1985 | Strauss | 313/477 R X |

FOREIGN PATENT DOCUMENTS 2239609 2/1973 Fed. Rep. of Germany ..... 313/407

*Primary Examiner*—Palmer C. DeMeo

*Attorney, Agent, or Firm*—Ralph E. Clarke, Jr.

[57] ABSTRACT

A front assembly is disclosed for use in a color cathode ray tube. The assembly according to the invention comprises a glass faceplate having a target area with a pattern of phosphor deposits covered with an electron-pervious electrically conductive metallic film. A shadow mask support assembly includes a glass frame sealed to and constituting an integral part of the tube envelope for supporting a shadow mask in precise spaced adjacency to the target area. The frame has an electrically conductive frame coating on at least a portion thereof. An electrically conductive foil shadow mask adapted to be charged with a high voltage is mounted in tension on the frame in electrical contact with a conductive frame coating. Conductive means which may comprise spring means is in contact with the mask or the conductive frame coating and the metallic film or a conductive extension thereof for conducting high voltage on the mask to the metallic film. A funnel has an anode button therethrough for receiving a high voltage, and anode spring means attached to the anode button and having a distal end in contact with the conductive frame coating for conducting the high voltage to the shadow mask. As a result, the high voltage applied to the anode button is conducted to the frame, the foil mask and the metallic film.

11 Claims, 4 Drawing Figures

COLOR CRT TENSION MASK SUPPORT ASSEMBLY WITH A GLASS FRAME

CROSS-REFERENCE TO RELATED PATENT APPLICATIONS

This application is related to but in no way dependent upon copending applications Ser. Nos. 538,001, now U.S. Pat No. 4,593,224, and 538,003 both filed Sept. 30, 1983; Ser. Nos. 572,088, now U.S. Pat. No. 4,547,696, and 572,089, now U.S. Pat. No. 4,595,857 both filed Jan. 18, 1984; Ser. No. 646,861, now U.S. Pat. No. 4,614,892, filed Aug. 31, 1984; and Ser. No. 735,887 filed May 17, 1985; Ser. No. 729,020, filed Apr. 30, 1985; Ser. No. 725,040, filed Apr. 19, 1985; Ser. 727,486, filed Apr. 26, 1985; Ser. No. 729,015, filed Apr. 29, 1985; Ser. No. 754,786 filed July 12, 1985; and Ser. No. 758,174 filed July 23, 1985, all of common ownership herewith.

BACKGROUND OF THE INVENTION

This invention relates to color cathode ray picture tubes of the type having a tensed foil shadow mask for color selection, and is particularly concerned with means and method for establishing the mask and the imaging screen at the proper electrical potential.

The area enclosed by the funnel and faceplate of a color cathode ray picture tube is typically established as a field-free region for the excursion of the electron beams that selectively excite the pattern of discrete phosphor targets deposited on the inner surface of the faceplate that comprises the picture imaging screen. In cathode ray tubes having the tensed foil mask, the faceplate and the corresponding picture imaging screen are usually flat. The field-free region is established by charging the inner surfaces of the funnel and the faceplate and adjacent components to a high potential, typically in the range of 20–25 kilovolts. The surfaces so charged include the conductive coating deposited on the inner surface of the funnel, and an electrically conductive film, normally aluminum, disposed on the back of the picture imaging screen over the phosphor deposits. The shadow mask must also be charged to the same high potential. The shadow mask, which in this case is a tensed foil, is precisely mounted in relation to the screen by means described and fully claimed in one of the referent copending applications heretofore listed. The electrically conductive coating on the surface of the funnel receives the high potential from the metallic "anode button" that protrudes through the wall of the funnel, and which in turn is connected to a conductor leading from a high-voltage power supply.

The luminescing material of the viewing screen commonly comprises a layer of one or more phosphors of different color emission deposited on the inner surface of the display faceplate. This phosphor material is usually "aluminized"; that is an electron-pervious film of aluminum is deposited on the phosphors. The film increases the brightness of the display by acting as a mirror to reflect toward the viewer the light produced by the phosphors when activated by the electron beams. The film typically also carries the high-voltage charge to act as an electron-attractive ultor electrode for the display. The thickness of the film, which is very fragile and easily abraded, is typically about 2,000 Angstroms.

In U.S. Pat. No. 3,489,966 to Bradu et al, there is disclosed a cathode ray tube with a stainless steel post-focusing grid sealed between the sealing lands and the faceplate skirt and the funnel. The grid of wires is cut at the outer surface of the envelope, and a conducting layer on the exterior of the envelope coats the envelope zone which comprises the ends of the wires. A layer of sealing and insulative material over the conducting layer is said to provide for air-tightness and high-voltage integrity. The conductive layer also makes contact with a high-voltage connector for energizing the grid wires. In another configuration in which the high-voltage is applied to the screen, the screen receives operating potential through a terminal which penetrates the faceplate skirt; this terminal in turn is connected to the screen by a conductive paint layer.

A post-deflection cathode ray tube is disclosed in U.S. Pat. No. 3,502,942 to Kahn et al. A unitary color selection and focus-electrode assembly comprises a first electrode for color selection, and a second lens element formed as a mesh of electrical conductors. The color selection electrode and focus electrode assembly are insulated from each other, and each has a different potential thereon. The tube has two conductive coatings on the inside of the envelope, one of which is located on the internal surface of the funnel, but stops short of the plane of the electrode assembly. High voltage for beam acceleration is conducted to the coating through an anode button that penetrates the funnel. A flexible electrical conductor interconnects the color selection electrode with the funnel coating. The second coating is located on the inner surface of the faceplate skirt, and a high voltage for post-deflection focusing is conducted to the coating through a second anode button that penetrates the skirt. A separate spring-like connector projects from the PDF electrode to make contact with a second coating.

Barr in U.S. Pat. No. 3,541,373 discloses a cathode ray tube with a bifurcated spring bridging the shadow mask frame and an internal conductive coating. The spring clips onto the rigid frame, or alternately, is welded to the shadow mask. The distal end makes contact with the inner conductive coating on the funnel which is electrically charged to a high potential. The novelty is said to lie in the bifurcation of the distal end, in which each of two independently operating tines has a different vibration frequency. The result is said to be a more shock-resistant connection and the avoidance of electrical interruption. Also, the positive contact is said to make possible the use of a weaker spring with reduced possibility of mechanical erosion of the conductive coating.

In Davis et al—U.S. Pat. No. 3,898,510—there is set forth through-the-seal conductive means for traversing a CRT envelope seam to effect multiple connections therein. An internal spring-like conductive member straddles the seam at the junction of the funnel and the faceplate skirt to electrically connect the funnel internal conductive coating and the conductive coating on the screen. A conductive member extends through the seam to interconnect the conductive member with an external high voltage connector.

In U.S. Pat. No. 4,333,037 to Andre et al, there is disclosed an arrangement to compensate for the mask-to-screen misregister that occurs when the mask is heated by electron bombardment. A thermally sensitive resistant section inside the tube adjacent to the shadow mask produces a voltage difference between the mask and screen which compensates for misregister caused by the displacement of the electron beams from normal landing points as the mask heats up during the operation. The resistant section may comprise either a PTC or NTC type resistor. The resistance elements are in effect in series with the high-voltage path between the electrically charged inner conductive coating of the funnel and the conductive coating on the screen. The heating of the resistors regulates the potential applied to the screen to provide compensatory electrical correction of the beam landing areas.

Marschka in U.S. Pat. No. 4,344,015 describes a screen contact means for a cathode ray tube. An anode button projecting through the funnel is attached to a screen contact assembly that conducts high voltage directly to the screen, while bridging the gap at which the funnel and faceplate are sealed together. A Nichrome foil member is placed beneath the screen contact point of the conductive member to serve as a non-abrading pad. A member attached transversely to the contact assembly provides for screen-pressure contact with the conductive coating on the inner surface of the funnel.

The following U.S. Patents are also noted: 3,404,303; 4,230,965; 4,243,908; 4,333,033; and 4,433,267.

OBJECTS OF THE INVENTION

It is a general object of the invention to provide electrical bridging means for establishing certain internal components at a common electrical potential in color cathode ray tubes having the tensed foil shadow mask.

It is another object of the invention to electrically energize a tensed foil shadow mask mounted on an insulative material.

It is a more specific object of the invention to provide means for establishing the screen and shadow mask at the same high potential.

BRIEF DESCRIPTION OF THE DRAWINGS

The features of the present invention which are believed to be novel are set forth with particularity in the appended claims. The invention together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
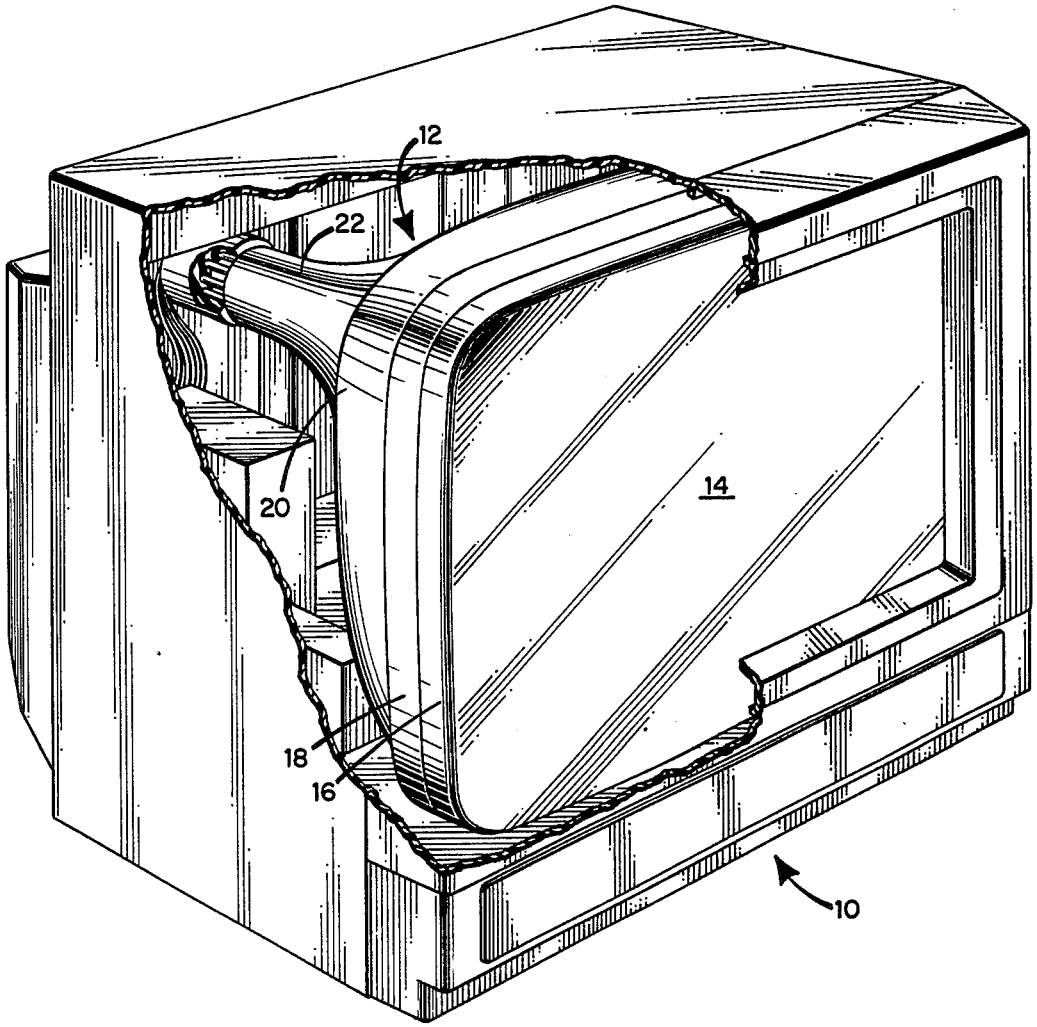
FIG. 1 is a cut-away view in perspective of a cabinet that houses a high-resolution color cathode ray tube, showing certain major components which are the subject of the present invention.

FIG. 1 shows a novel video monitor 10 that houses a high-resolution color cathode ray tube 12, certain components of which can be manufactured according to the present invention. Various features and improvements of the tube 12 are illustrated and described in the referent copending applications assigned to the assignee of the present invention. The design of the monitor is the subject of copending design patent application Ser. No. 725,040 of common ownership herewith. The monitor, and the associated tube, are notable not only for high resolution, but also for the flat imaging area 14 that makes possible the display of images in undistorted form. Imaging area 14 also offers a more complete picture as the corners are relatively square in comparison with the more rounded corners of the conventional cathode ray tube.

Figure 2:
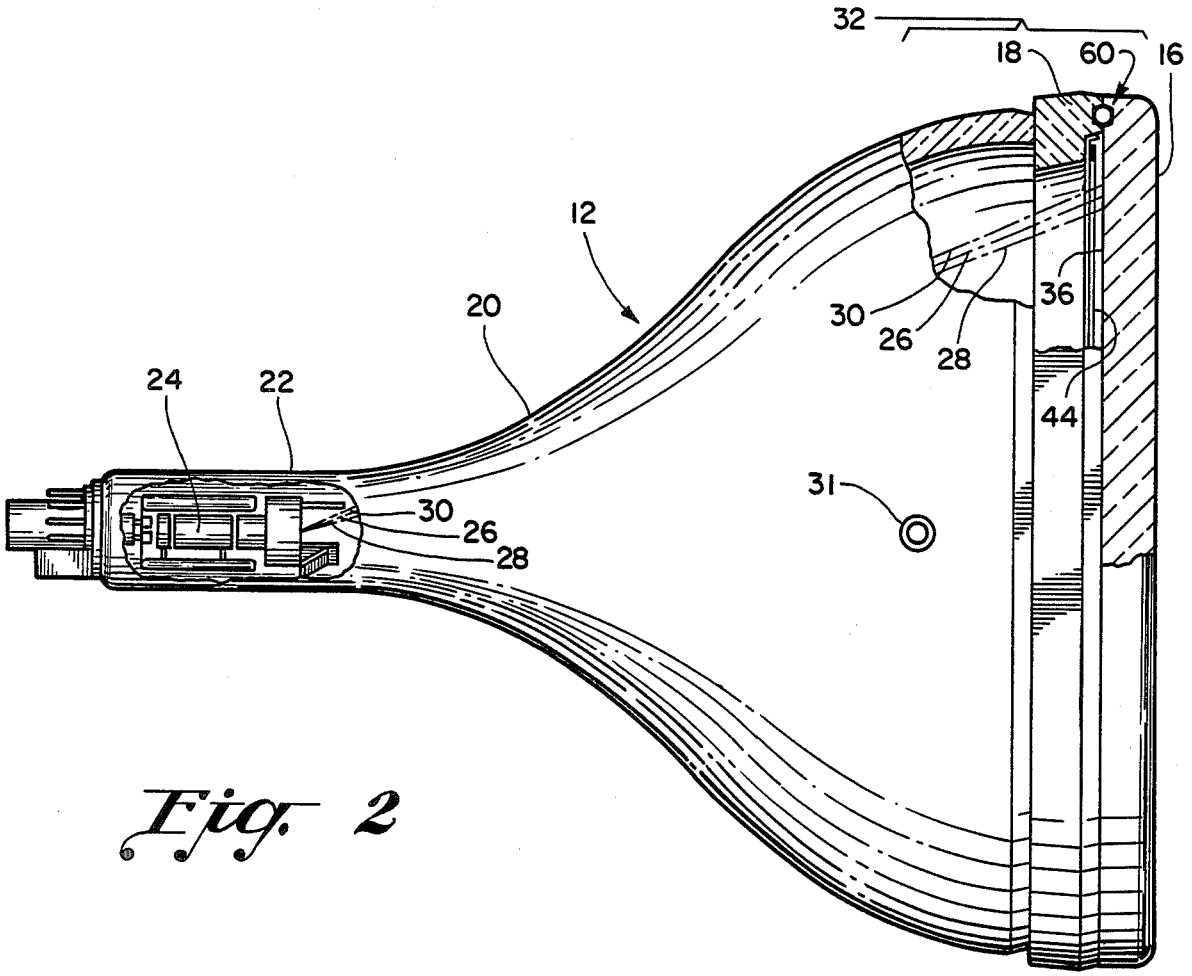
FIG. 2 is a side view in elevation of the color cathode ray tube of FIG. 1 showing another view of the components depicted in FIG. 1 together with two cut-away sections depicting internal components.

High-resolution cathode ray tube 12 is shown in FIGS. 1 and 2 as having a flat glass faceplate 16. Faceplate 16 is depicted as being attached to a shadow mask support assembly 18 which in turn is joined to a rear envelope section, here shown as a funnel 20 which tapers down to a narrow neck 22. Neck 22 is shown as enclosing an electron gun 24 which is indicated as projecting three electron beams 26, 28 and 30 on the inner surface 32 of faceplate 16. Inner surface 32 has a pattern of triads of red-emitting, green-emitting, and blue-emitting phosphor deposits which emit light when energized by respective ones of the electron beams 26, 28 and 30. An anode button 31 provides for receiving and conducting high voltage through the wall of funnel 20 for electrically energizing according to the invention certain internal components, as will be described.

Figures 3, 3A:
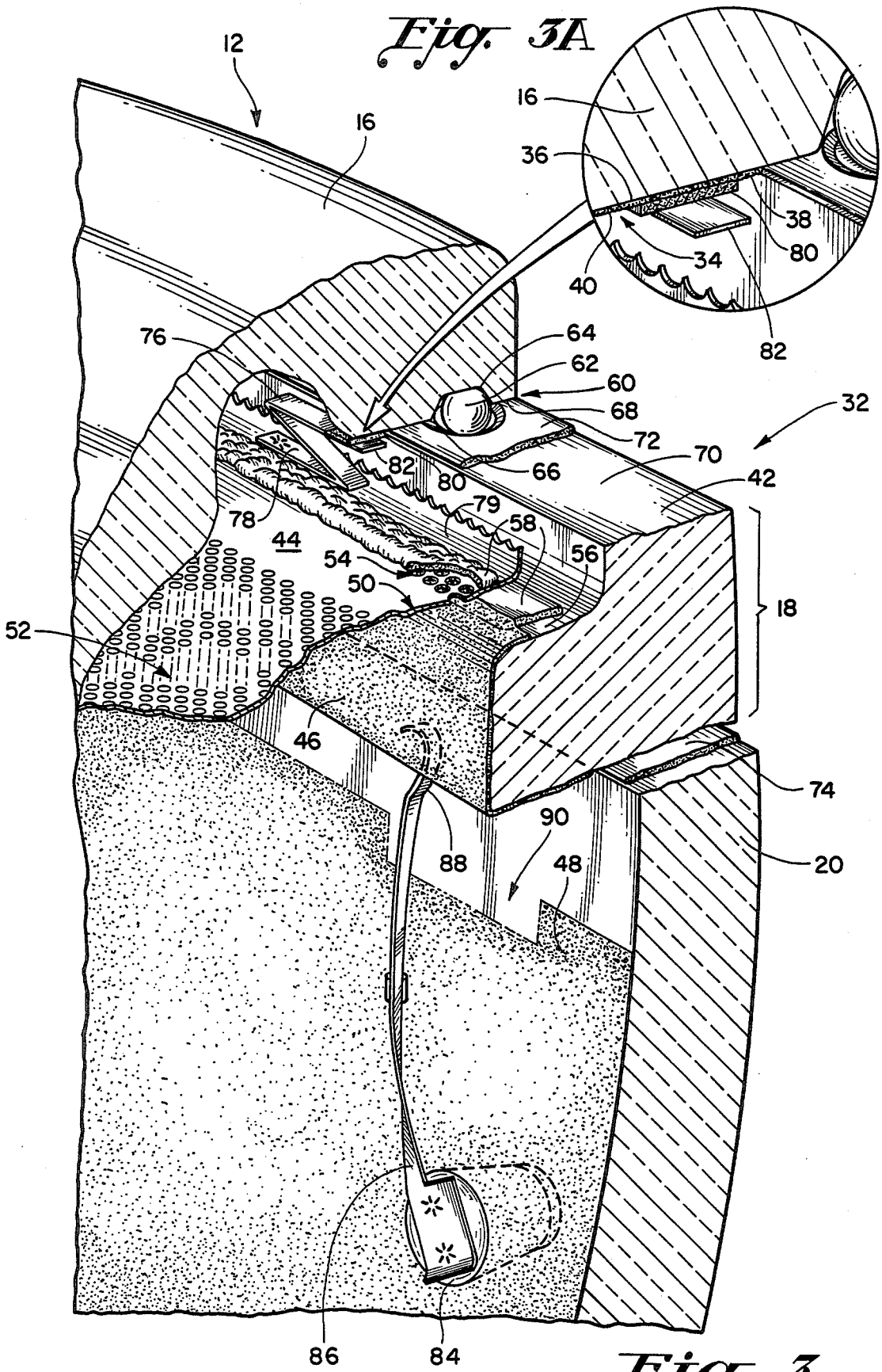
FIG. 3 is an enlarged cut-away exploded view in perspective of a section of the tube of FIG. 2 showing details of the means according to the invention.
FIG. 3A is an inset showing an enlarged detail of an inventive concept depicted in FIG. 3.

A front assembly 32 according to the invention for use in a color cathode ray tube is indicated by the bracket in FIG. 2, and is shown in partial section 32 in FIG. 3. The front assembly 32 comprises the components described in the following paragraphs.

With reference to the inset, FIG. 3A, glass faceplate 16 has a target area 34 on its inner surface 36 with a pattern of phosphor deposits 38 thereon. The deposits are covered with an electron-pervious, electrically conductive, metallic film 40 (the film 40 is not shown in the figure as it is only about 2,000 Angstroms thick).

The shadow mask support assembly 18 includes a glass frame 42 indicated as being sealed to and constituting an integral part of the envelope of tube 12. Support assembly 18 provides for supporting shadow mask 44 in precise, spaced adjacency to target area 34, a dimension known as the "Q" distance. Frame 18 is indicated as having an electrically conductive frame coating 46, indicated by the stipple pattern on frame 18, on at least a portion thereof. The conductive coating 46 may comprise, for example, a material known as "dag" usually formulated as an iron oxide which, although electrically conductive, also has slightly electrically resistive properties to prevent charge build-up. Dag is also compounded to be highly adherent, easily applicable, and resistant to chipping or flaking off. A similar dag coating 48 is typically applied to the interior of the funnel 20, as indicated by the stipple pattern.

The electrically conductive foil shadow mask 44 is adapted to be charged to a high voltage and is mounted in tension on frame 42 in electrical contact with the conductive frame coating 46. A typical area of contact between the mask 44 and the conductive coating is indicated by reference number 50 and the associated arrow.

Shadow mask 44 comprises a first central field of apertures 50 which provide for color selection in the finished tube, and a second field of apertures 52 peripheral to the first field 52. Second field 54 is substantially uniformly spaced from the first field 52 and coincident with the shadow mask support surface 56 of frame 42 for receiving a first layer 58 of cementing means during assembly of the mask 44 into a cathode ray tube. The apertures in second field 54 are in the form of a band of substantially uniform width at least along the sides of the mask 44, and are small in diameter relative to the width of the band. The embodiment of the shadow mask 44 as shown is not the subject of the present application, but is fully described and claimed in referent copending application Ser. No. 729,020.

In the embodiment shown by FIGS. 2 and 3, tube 12 is indicated as having internal indexing means for interregistering the faceplate 16 and frame 18. The sets of indexing means, typically three in number, are internally spaced at preselected locations about the periphery of the faceplate 16; one of the sets is shown in FIGS. 2 and 3 at 60. Indexing means 60 in this prior art embodiment is depicted as comprising a ball 62 which rides in mating grooves 64 and 66 in the faceplate sealing surface 68 and the support surface 70 of frame 42, respectively. The sealing surface 68 of frame 16 and the support surface 70 of frame 42 are indicated as being joined or "sealed" by a second layer of cement 72. The frame 42 and funnel 20 of tube 12 is shown as being joined by a third layer of cement 74, at the frame-funnel junction. As a result, the color electrode assembly 18 is sealed integrally between faceplate 16 and the rear section of the color cathode ray tube envelope so as to become an integral part of the envelope. The indexing means shown and variations thereof are not the subject of the present application but are described and fully claimed in varous ones of the referent copending applications Ser. Nos. 572,088 and 572,089; Ser. No. 729,015; Ser. No. 735,887; and Ser. No. 727,486.

The layers of cement 58, 72 and 74 may be in the form of a devitrifying glass frit such as that supplied by Corning Glass Works of Corning, New York under the designation Glass 7595. A devitrifying frit is compounded as a glass which is viscous at ambient temperatures but which crystallizes and hardens when heated to a predetermined temperature, it does not remelt upon reheating so that a permanent bond is made.

Conductive means according to the invention in contact with the mask 44 or the conductive frame coating 46, and in contact with the metallic film 40 or a conductive extension thereof provide for conducting a high voltage on the mask 44 to the metallic film 40. The conductive means may comprise spring means 76 depicted as being a Z-shaped member, one leg 78 of which is shown as being welded (by the weld symbol) to the shadow mask 44. The foil shadow mask 44, which is sealed to frame 42, will be seen to have a peripheral area 79 extending beyond the sealed portion thereof, the sealed portion being the aforedescribed second field of apertures which is attached, or sealed, by cement 40. Spring means 76 is indicated as making electrical contact with peripheral portion 79 of foil mask 44 according to the invention. The spring means 76 can be formed from Hastelloy(R) alloy B-2 supplied by the Stellite Division of Cabot Corp., Kokomo, Ind. The spring blank can easily be cut from one-mil sheet stock and formed into the preferred Z-shape by one skilled in the art.

The conductive extension of metallic film 40 comprises according to the invention a patch of electrically conductive dag 80 for receiving the distal end 82 of spring means 76. The conductive dag may comprise the electrically conductive bridge material described and fully claimed in U.S. Pat. Nos. 4,289,800 and 4,301,041 to Shah, of common ownership herewith. This specially formulated material has the necessary electrical conductivity, adherence, and abrasion-resistant properties required of a conductive extension of the metallic film 40 according to the invention.

Funnel 20 is depicted as having an anode button 84 therethrough for receiving a high voltage. The voltage is conducted to an external connection from a high-voltage power supply (not shown). Anode spring means 86 attached to anode button 84 as by welding (indicated by the weld symbol) has a distal end 88 in contact with the conductive frame coating 46 for conducting high voltage to shadow mask 44.

A window 90 will be seen as comprising a cut out area of conductive coating 48 which is deposited on the interior of funnel 20. Window 90 is provided for viewing the distal end 84 of anode spring 86 from the outside of the tube to verify the proper seating and positive electrical contact of distal end 88 with conductive coating 46 of frame 42.

As a result, and in accordance with the invention, high voltage applied to the anode button 84 is conducted to the frame 42, the foil mask 44 and the metallic film 40.

A shadow mask assembly for use in a color cathode ray tube comprises according to the invention a glass frame 42 on at least one portion of which is disposed a conductive coating 46, and a foil shadow mask 44 supported in tension on the frame 42 in electrical contact with the conductive coating 46.

While a particular embodiment of the invention has been shown and described, it will be obvious to those skilled in the art that changes and modifications may be made in the inventive means without departing from the invention in its broader aspects, and therefore the aim of the appended claims is to cover all such changes and modifications as fall within the true spirit and scope of the invention.

We claim:

1. A front assembly for use in a color cathode ray tube, comprising:

a glass faceplate having a target area with patterns of phosphor deposits thereon covered with an electron-pervious electrically conductive metallic film;

a shadow mask support assembly including a glass frame for supporting a mask in precise spaced adjacency to said target area, said frame having at least a surface portion which is electrically conductive;

an electrically conductive foil shadow mask adapted to be charged with a high voltage and mounted in tension on said frame in electrical contact with said surface portion thereof; and electrically conductive spring means supported by and in electrical contact with said mask and engaging said metallic film on said target area or a conductive extension thereof, for conducting high voltage on said mask to said metallic film.

2. The front assembly according to claim 1 wherein said spring means is a Z-shaped member, one leg of which is welded to said foil mask.

3. The front assembly according to claim 2 wherein said conductive extension of said metallic film is a patch of electrically conductive dag for receiving a distal end of said spring means.

4. A front assembly for use in a color cathode ray tube, comprising:

a glass faceplate having a target area with a pattern of phosphor deposits thereon covered with an electron-pervious electrically conductive metallic film;

a shadow mask support assembly including a glass frame sealed to and constituting an integral part of the tube envelope for supporting a mask in precise spaced adjacency to said target area, said frame having an electrically conductive frame coating on at least a portion thereof;

an electrically conductive foil shadow mask adapted to be charged with a high voltage and mounted in tension on said frame in electrical contact with said conductive frame coating; and conductive means in contact with said mask or conductive frame coating and said metallic film or a conductive extension thereof, for conducting high voltage on said mask to said metallic film.

5. The front assembly according to claim 4 wherein said conductive means comprises a spring, one end of which is attached to said mask, and the distal end of which is in electrical contact with said extension of said conductive film.

6. A front assembly for use in a color cathode ray tube, comprising:

a glass faceplate having a target area with a pattern of phosphor deposits thereon covered with an electron-pervious, electrically conductive metallic film;

a shadow mask support assembly including a glass frame for supporting a mask in precise spaced adjacency to said target area, said frame having at least a surface portion which is electrically conductive;

an electrically conductive foil shadow mask adapted to be charged with a high voltage and mounted in tension on said frame in electrical contact with said surface portion thereof;

electrically conductive spring means supported by and in electrical contact with said mask and engaging said metallic film on said target area or a conductive extension thereof for conducting said high voltage on said mask to said metallic film;

a funnel having an anode button therethrough for receiving a high voltage;

anode spring means attached to said anode button and having a distal end in contact with said surface portion of said frame for conducting high voltage to said frame and said shadow mask;

whereby high voltage applied to said anode button is conducted to said frame, said foil shadow mask, and said metallic film on said target area.

7. The apparatus defined by claim 6 wherein said electrically conductive spring means is Z-shaped, one leg of which is welded to said mask, and the distal end of which makes contact with said extension of said metallic film.

8. A front assembly for use in a color cathode ray tube comprising:

a glass faceplate having a target area with a pattern of phosphor deposits thereon covered with an electron-pervious electrically conductive metallic film;

a shadow mask support assembly including a glass frame sealed to and constituting an integral part of the tube envelope for supporting a shadow mask in precise spaced adjacency to said target area, said frame having an electrically conductive frame coating on at least a portion thereof;

an electrically conductive foil shadow mask adapted to be charged with a high voltage and mounted in tension on said frame in electrical contact with said conductive frame coating;

conductive means in contact with said mask or conductive frame coating and said metallic film or a conductive extension thereof for conducting high voltage on said mask to said metallic film;

a funnel having an anode button therethrough for receiving a high voltage;

anode spring means attached to said anode button and having a distal end in contact with said conductive frame coating for conducting high voltage to said shadow mask;

whereby said high voltage applied to said anode button is conducted to said frame, said foil mask, and said metallic film.

9. The apparatus defined by claim 8 wherein said conductive means comprises spring means, one end of which is welded to said mask and the distal end of which makes electrical contact with said extension of said metallic film.

10. The apparatus defined by claim 9 wherein said foil mask is sealed to said frame and has a peripheral area extending beyond the sealed portion thereof, and wherein said spring means makes electrical contact with said peripheral portion of said foil mask.

11. For use in a color cathode ray tube, a shadow mask support assembly comprising glass frame means having a recessed support surface supporting a metallic foil shadow mask in a tensed state and cemented to said recessed support surface by cementing means, and adapted to be sealed integrally between a faceplate and a rear section of a CRT envelope such as to become an integral component of said envelope when sealed therein, said shadow mask further comprising a first, central field of apertures for color selection, and a second field of apertures peripheral to said first field and substantially uniformly spaced therefrom and coincident with said support surface for receiving said cementing means during assembly of the mask into a cathode ray tube, said apertures in said second field of apertures being in the form of a band of substantially uniform width at least along the sides of said mask, said apertures being small in diameter relative to said width of said band, said glass frame means having an electrically conductive coating thereon in electrical contact with said shadow mask for conducting high voltage applied to said frame means to said shadow mask.

* * * * *